United States Patent [19]

Ogden

[11] Patent Number: 4,702,691

[45] Date of Patent: Oct. 27, 1987

[54] EVEN FLOW RADIAL BURNER TIP

[75] Inventor: Richard Ogden, Bristow, Okla.

[73] Assignee: John Zink Company, Tulsa, Okla.

[21] Appl. No.: 894,703

[22] Filed: Aug. 7, 1986

Related U.S. Application Data

[63] Continuation of Ser. No. 592,013, Mar. 19, 1984, abandoned.

[51] Int. Cl.[4] ..... F23C 7/00

[52] U.S. Cl. ..... 431/187; 431/346; 431/354; 239/552; 239/553

[58] Field of Search ..... 431/348, 202, 354, 171, 431/114, 108, 353, 127, 346; 239/553.3, 553, 552; 126/39 E

[56] References Cited

U.S. PATENT DOCUMENTS

| | | | |
|---|---|---|---|
| 563,630 | 7/1896 | Webster | 239/552 |
| 794,225 | 7/1905 | Humphrey | 239/552 |
| 1,923,393 | 8/1933 | Pickup | 239/552 X |
| 2,224,450 | 12/1940 | Scofield | 239/553 X |
| 2,537,542 | 1/1951 | Norman | 239/552 X |
| 2,669,300 | 2/1954 | Blaha | 431/348 |
| 2,671,507 | 3/1954 | Morck | 431/348 |
| 3,000,435 | 9/1961 | Bloom et al. | 431/348 |
| 3,076,498 | 2/1963 | Williams et al. | 431/348 |
| 3,182,712 | 5/1965 | Zinlz et al. | 431/348 X |
| 3,311,155 | 3/1967 | Hershey et al. | 431/114 |
| 3,684,424 | 8/1972 | Zinlz et al. | 431/353 X |
| 3,773,075 | 11/1973 | Thompson et al. | 431/354 X |
| 3,940,234 | 2/1976 | Reed et al. | 431/348 |

FOREIGN PATENT DOCUMENTS

| | | | |
|---|---|---|---|
| 78156 | 1/1894 | Fed. Rep. of Germany | 239/558 |
| 448052 | 7/1927 | Fed. Rep. of Germany | 239/552 |
| 2035563 | 1/1972 | Fed. Rep. of Germany | 431/354 |
| 188684 | 11/1922 | United Kingdom | 239/552 |
| 691818 | 5/1953 | United Kingdom | 431/348 |
| 828502 | 2/1960 | United Kingdom | 431/348 |
| 933591 | 8/1963 | United Kingdom | 431/348 |
| 1257053 | 12/1971 | United Kingdom | 239/552 |

*Primary Examiner*—Randall L. Green

*Attorney, Agent, or Firm*—Head & Johnson

[57] ABSTRACT

A gas burner assembly supported in an opening in a furnace wall has injected gas and/or air flowing through an inner burner tube then outwardly through a plurality of openings for burning along the surface of a wall thus providing a near uniform radiant heat energy to the furnace. A flow divider positioned opposite the openings divides the flowing gas and/or air to improve distribution, and retard flashback in the event of variations in fuel-air mixture and/or flow.

4 Claims, 7 Drawing Figures

Fig. 5
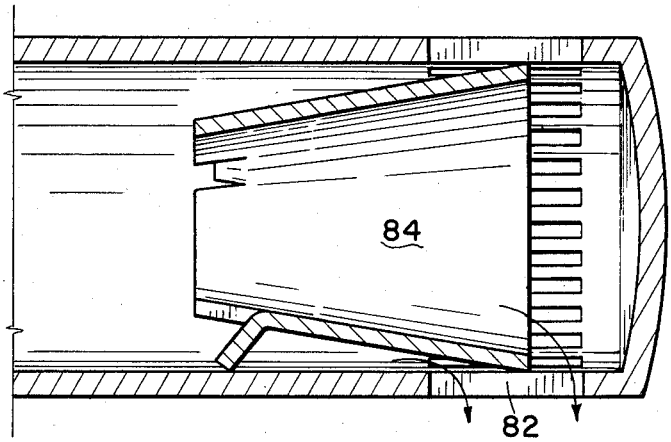
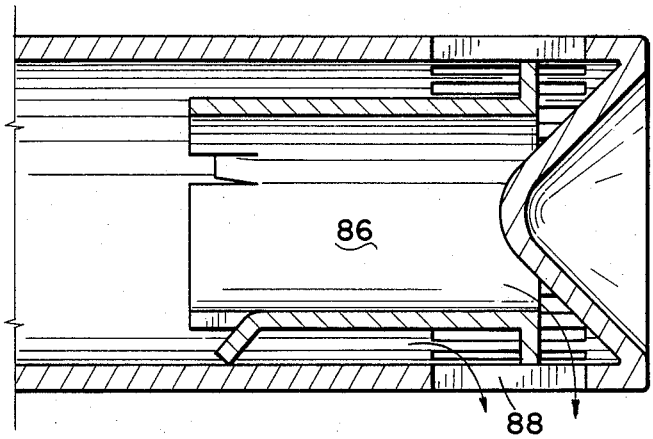
Fig. 6
Fig. 7
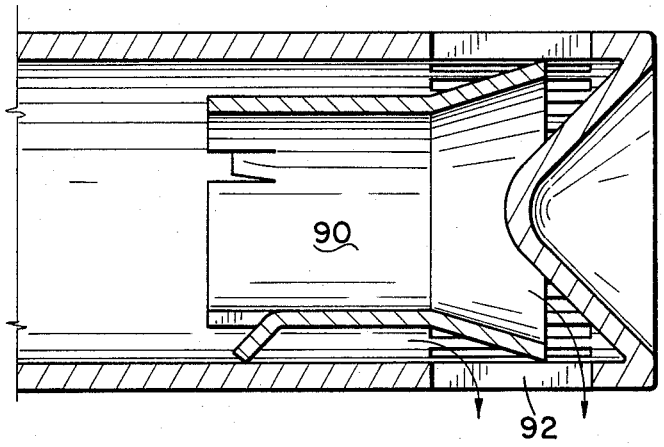

EVEN FLOW RADIAL BURNER TIP

This is a continuation of copending application Ser. No. 592,013, filed on Mar. 19, 1984, abandoned.

BACKGROUND OF THE INVENTION

This invention is an improvement upon radiant wall burning apparatus such as that which has been heretofore developed and patented and typically shown in the following U.S. Pat. Nos.:

3,416,735
3,684,424
4,257,762

The invention is directed to a burner which inspirates or educts air with gas to burn beyond openings at the end of a burner tube. In addition, the invention is applicable to a burner that uses forced air or forced air and gas for burning outside openings at the end of a burner tube. The outlet slots or openings must allow maximum emission of the gas-air mixture at sufficient velocity to prevent flashback into the burner tube.

SUMMARY OF THE INVENTION

It is an object of this invention to maintain efficient burning of radiant wall burner apparatus despite changes in velocity of the combustible gases and/or changes in types of fuel.

It is another object of this invention to provide, at the outlet of a radiant furnace wall burner tube, apparatus to make the outward flowing velocity substantially uniform through the openings at the tip. A further object is to provide improved distribution of air or gas-air mixtures through the openings or slots provided at the end of the burner tube adjacent a furnace wall.

It is to be understood that the invention is for use with a variety of gas-air, or air-gas mixing burners. For example, the invention includes burners using forced air pre-mixed with gas or alone such as found in U.S. Pat. No. 4,257,762, the invention being directed to the division of fluid flow at the downstream tip.

A particular description of the invention provides a gas burner assembly for furnaces in which a stream of high velocity fuel gas issues from an orifice to inspirate combustion supporting air into and mix with the air in a mixing section of a burner pipe. The burner pipe is inserted into an oversized opening through the wall of the furnace terminating at a downstream end adjacent and beyond the inner wall of the furnace. The inner wall of the furnace surrounding the furnace opening typically includes a radiant wall surface. The downstream end of the burner pipe is closed. A plurality of openings such as slots or holes are provided in the burner pipe adjacent the downstream end to project gas-air mixtures issuing therefrom, outwardly along the radiant furnace wall surface for burning. A flow divider comprised of an undersized cylindrical member is centrally located permanently or temporarily inside the burner tube adjacent the downstream end. The downstream end of the flow divider is oriented in close proximity to the inside periphery of the burner tube at said openings to effectively divide the openings into what is defined herein as a downstream flowing portion and an upstream flowing portion. The cylindrical flow-divider causes that portion of the fuel-air mixture which passes through the inside of the flow divider to be directed through the downstream portion of the openings. The remaining portion of the fuel-air mixture which passes through the annular space located between the flow divider and the burner tube flows through the upstream portion of the openings.

BRIEF DESCRIPTION OF THE DRAWING

FIGS. 5, 6 and 7 depict other forms of flow divider baffles within the scope of the invention.

DETAILED DESCRIPTION OF THE PREFERRED EMBODIMENT

Before explaining the present invention in detail, it is to be understood that the invention is not limited in its application to the details of the construction and arrangement of parts illustrated in the accompany drawings. The invention is capable of other embodiments and of being practiced or carried out in a variety of ways. It is to be understood that the phraseology and terminology employed herein is for the purpose of description and not of limitation.

Figure 1:
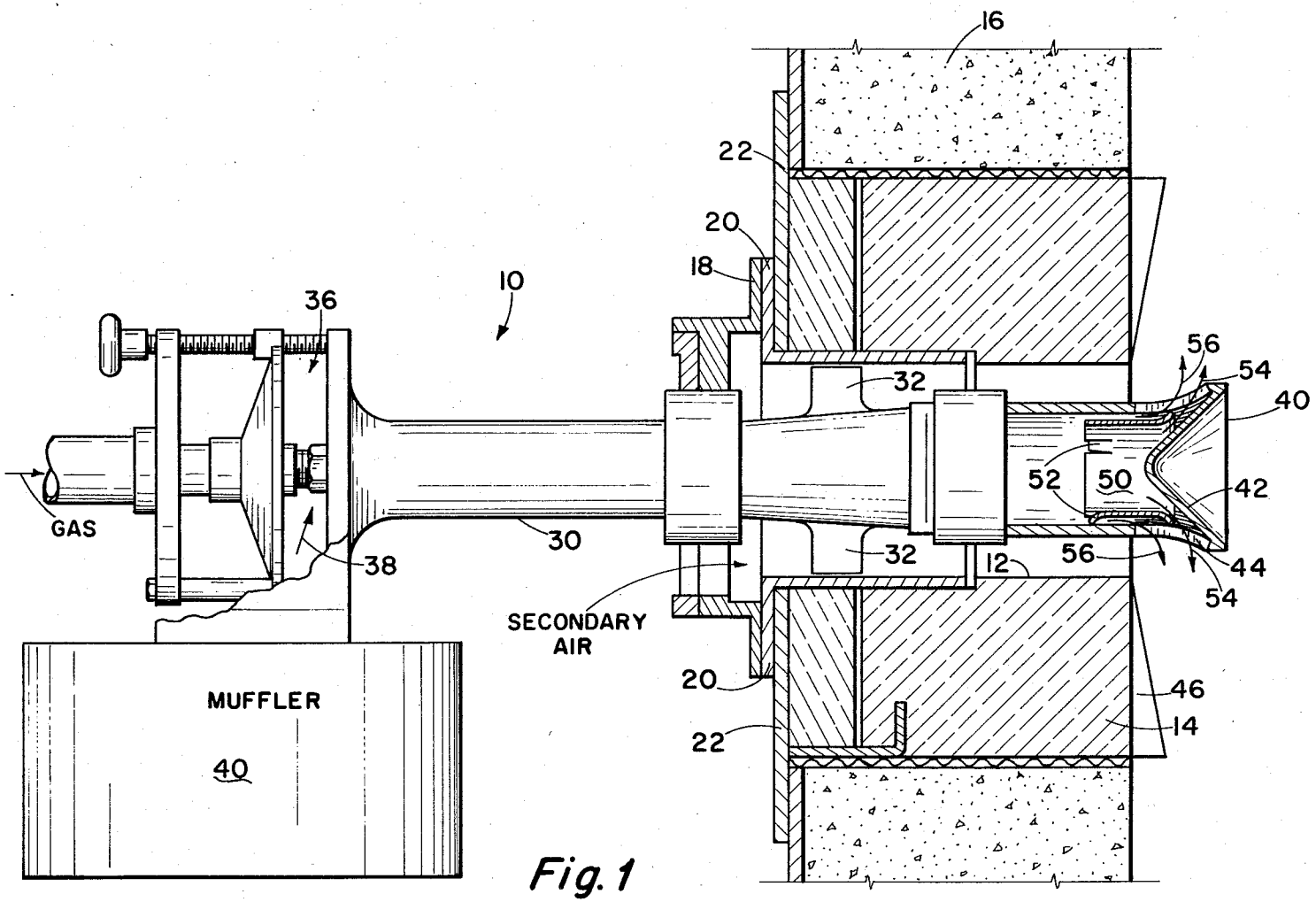
FIG. 1 is a partial sectional view describing the apparatus of this invention as it can be located in a furnace wall.
Figure 2:
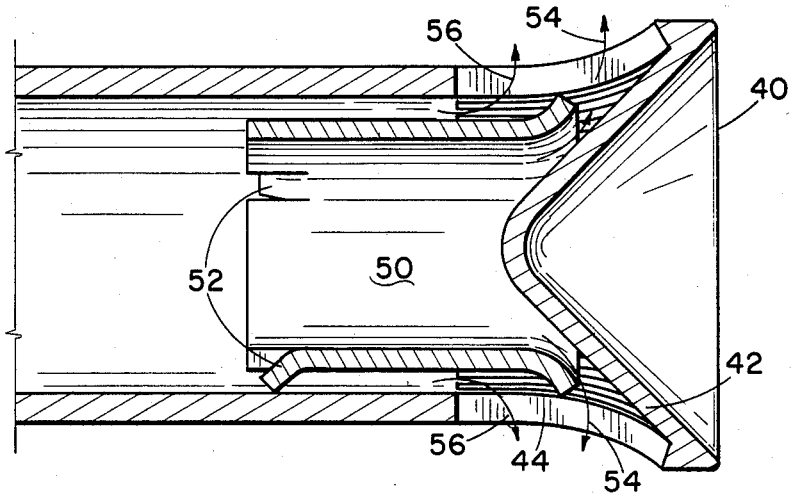
FIG. 2 is an enlarged sectional view of the tip of FIG. 1.

The burner assembly of FIGS. 1 and 2 is generally designated by the numeral 10 is inserted through an opening 12 formed as a part of a burner block 14 located through furnace wall 16. The basic gas-air mixing burner assembly shown here is merely typical, as the invention is not to be limited to that type shown. The burner assembly is supported by a mounting plate 18 as by welding or bolting to plates 20 and/or 22. The mounting plate centrally supports the burner tube 30 and includes openings which may be regulated for the flow of secondary air as shown. Centering lugs 32 may be provided in the annular space between the burner tube and the mounting thimble or plate 20. By supplying gas into the aspirator section 36, primary air, from a muffler 40, is caused to be inspirated at 38 into the burner tube 30 where it is mixed with the gas and thence caused to issue from the downstream end 40.

As stated, this invention is directed to improvements in the flow of the gas-air mixture from the downstream end. A conical shaped plug 42 typically closes the downstream end. A plurality of spaced openings or slots 44 are provided around the circumference of the downstream end of the burner tube 30. These openings 44 project gas and air essentially outwardly for burning along the furnace wall and tile surface 46 which is capable of providing additional radiant heat energy to the interior of the furnace as is known in the art. The invention is particularly directed to a flow divider 50 which is provided in the interior of the burner tube, adjacent the downstream end. The flow divider is comprised of a cylinder which includes outwardly projecting lugs or feet 52 which centralize the flow divider in the position as shown. Other forms of centralizer means such as protrusions from the body of the cylinder and the like are inclusive of the invention. The flow divider can be permanently installed as by welding in a centralized position. The downstream end of the flow divider is caused to be oriented in close proximity to the inside periphery of the burner tube at said openings, thus dividing the openings into a downstream flow 54 and an upstream flow 56.

Figure 3:
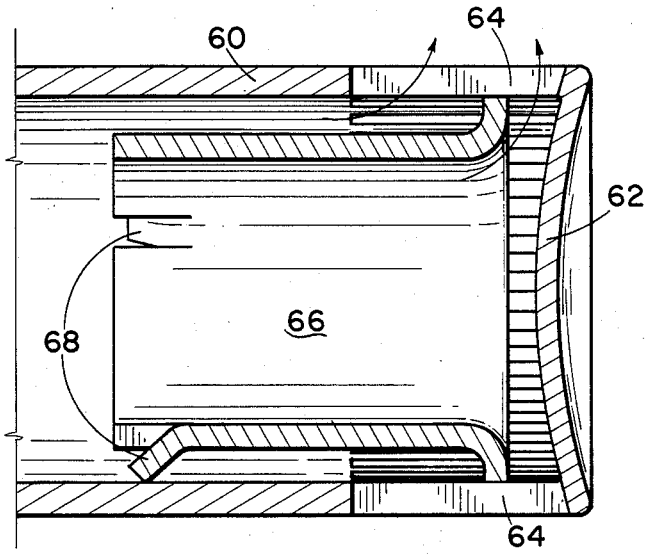
FIGS. 3 and 4 depict other embodiments of the invention.
Figure 4:
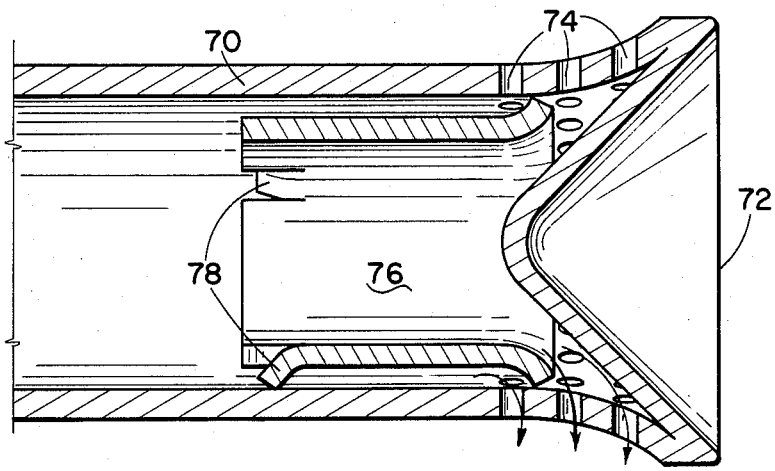

FIGS. 3 and 4 are directed towards other embodiments which are inclusive of the invention. In FIG. 3 a straight burner tube 60 is depicted having an end closure 62 and a plurality of slots 64 disposed inside the tip. In this embodiment the flow divider 66 disposed about the tip. In this embodiment the flow divider 66 with its' centralizing members 68 is shown. Likewise, in FIG. 4 the primary distinction is the use of a burner tube 70, which may be straight or curved as shown, having an end closure 72 and a plurality of holes 74 surrounding the tip. The flow divider 76 with its' centralizing members 78 is shown positioned with respect to that embodiment.

FIGS. 5, 6 and 7 depict different forms of flow dividers, such as an angularly inclined member 84 dividing slots 82 of FIG. 5, a right angle divider 86 dividing slots 88 of FIG. 7 and a beveled flow divider 90 dividing slots 92.

What is claimed is:

1. A gas burner assembly for furnaces in which a fluid stream of pre-mixed fuel and aspirated combustion supporting air flows through a burner pipe, said burner pipe inserted into an oversized opening through the wall of said furnace forming an annulus for the passage of secondary air therethrough, a downstream end of said burner pipe closed, a plurality of circumferentially spaced openings in said burner pipe adjacent said downstream end to project said fluid stream issuing therefrom outwardly to intersect and said secondary air for burning along a radiant furnace wall surface surrounding said burner pipe; a flow divider means centrally positioned inside of said burner pipe at the said downstream end, said flow divider means comprising a thin walled metallic cylindrical member of length substantially less than the length of said burner tube, the upstream end of said flow divider means being of lesser diameter than said burner pipe forming a substantially undivided annular flow space between said cylindrical member and the inside diameter of said burner pipe and an undivided inside central space, the cross-sectional area of said annular flow space being less than the cross-sectional area of said inside central space, the downstream end of said flow divider flaring outwardly so as to be contiguous with the inner periphery of said burner pipe opposite said openings to divide said openings into downstream openings and upstream openings, said flow divider diving said fluid stream into an undivided downstream portion which passes through said inside central space of said flow divider thence outwardly through said downstream openings and a substantially undivided upstream portion of said fluid stream which passes through said annular flow space thence through said upstream openings.

2. The burner of claim 1 wherein the downstream flaring outward portion of said flow divider contiguous with said openings has a curved surface.

3. The burner of claim 1 wherein the downstream flaring outward portion of said flow divider contiguous with said openings has a tapered or beveled surface.

4. The burner of claim 1 wherein the downstream flaring outward portion of said flow divider contiguous with said openings is approximately perpendicular to said openings.

* * * * *